United States Patent [19]

Oda

[11] 4,041,578

[45] Aug. 16, 1977

[54] AUTOMATIC LOCK SLIDER FOR SLIDE FASTENERS

[75] Inventor: Kiyoshi Oda, Kurobe, Japan

[73] Assignee: Yoshida Kogyo K.K., Japan

[21] Appl. No.: 741,191

[22] Filed: Nov. 12, 1976

[30] Foreign Application Priority Data

Nov. 14, 1975 Japan ..... 50-155378[U]

[51] Int. Cl.[2] ..... A44G 19/30

[52] U.S. Cl. ..... 24/205.14 R

[58] Field of Search ..... 24/205.14 R

[56] References Cited

U.S. PATENT DOCUMENTS

| | | | |
|---|---|---|---|
| 2,397,693 | 4/1946 | Rabinow | 24/205.14 R |
| 3,952,379 | 4/1976 | Fukuroi | 24/205.14 R |

*Primary Examiner*—Bernard A. Gelak

*Attorney, Agent, or Firm*—Bucknam and Archer

[57] ABSTRACT

An automatic lock slider for slide fasteners comprises a slider body having an upper and a lower wing connected by a neck portion, the upper wing having a recess for receiving a leaf spring and a through opening parallel with the leaf spring. A pull member is pivotally supported on the slider body and has at one of its ends a first cam held in abutting relation to the leaf spring and a second cam parallel to the first cam. A locking member is actuated by the second cam and has a locking prong movable through the through opening into the path of fastener elements and disposed in close proximity to the neck portion when the slider is in locked position. A support stud extends upwardly from the recess adjacent to the through opening and has a stop adapted to limit pivotal movement of the locking member, the stud serving as a pivot about which the locking member is rotatable.

6 Claims, 9 Drawing Figures

AUTOMATIC LOCK SLIDER FOR SLIDE FASTENERS

BACKGROUND OF THE INVENTION

This invention relates generally to slide fasteners and more particularly to an automatic lock slider therefor.

Many types of automatic lock sliders have been heretofore suggested and used, in which the locking member is brought into and out of engagement with adjacent fastener elements by rotating its associated pull member. More specifically, the locking member of the prior art included a downwardly extending projection disposed for engagement in a limited space between adjacent fastener elements that have been fully coupled together. This arrangement has a drawback in that the locking projection when manipulating the pull member to lock the slider, must force apart the adjacent elements of the fastener and in doing so, often damages the elements especially where the latter is made of a plastic filament.

SUMMARY OF THE INVENTION

It is therefore a primary object of the present invention to provide an improved automatic lock slider for slide fasteners in which the above noted disadvantages of the prior art are eliminated.

A more specific object of the invention is to provide an improved automatic lock slider which is positive and reliable in locking action.

Another object of the invention is to provide an improved automatic lock slider which has a relatively flat appearance and a minimum over-all thickness so as to withstand high compressive stress applied as by ironging or other pressing operations.

According to the invention, an automatic lock slider for slide fasteners comprises: a slider body having an upper and a lower wing connected by a neck portion, said upper wing having a recess for receiving a leaf spring and a through opening parallel with said leaf spring; a pull member pivotally supported on said slider body and having at one of its ends a first cam held in abutting relation to said leaf spring and a second cam parallel to said first cam; a locking member actuated by said second cam and having a locking prong movable through said through opening into the path of fastener elements and disposed in close proximity to said neck portion when the slider is in locked position; and a support stud extending upwardly from said recess adjacent said through opening and having a stop adapted to limit pivotal movement of said locking member, said stud serving as a pivot about which said locking member is rotatable.

The above objects and other features of the invention will appear clear from the following description taken in conjunction with the accompanying drawings which illustrate by way of example certain preferred embodiments which the invention may assume in practice.

DETAILED DESCRIPTION OF THE PREFERRED EMBODIMENTS

Referring now to FIGS. 1 to 4, there is shown an automatic lock slider 10 constructed in accordance with the principles of the invention, which slider generally comprises a slider body 11, a pull member 12 and a locking member 13 assembled together for use on a pair of fastener stringers (not shown) to open and close the slide fastener in a manner well known in the art.

Figure 5:
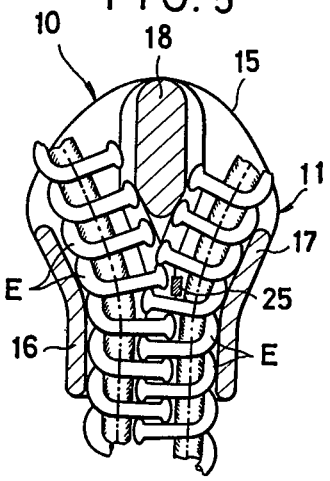
FIG. 5 is a sectional view of the slider utilized to explain the locking position of the locking prong relative to the fastener elements.

The slider body 11 includes an upper wing 14 and a lower wing 15, the upper wing 14 having side flanges 16,17 for guiding the fastener elements E (shown in FIG. 5) in their travel through the slider as is well known in the art. The wings 14 and 15 are connected at their one ends by a neck portion 18 which also serves as a divider for separating the coupled fastener elements in the operning movement of the slider 10. A pair of supporting lugs or bails 19,19' are formed on the upper wing 14 on opposite sides thereof to provide for connection of the pull member 12 which is hingedly connected to the bails 19,19' by a hinged pin 20.

Figure 4:
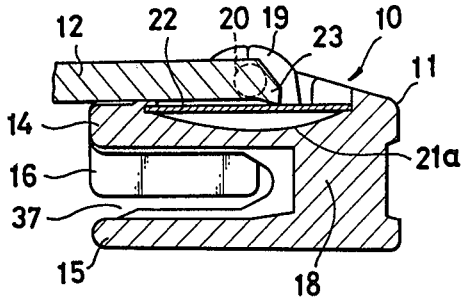
FIG. 4 is a longitudinal cross-sectional view taken on the line IV—IV of FIG. 1.

The upper wing 14 has an elongated recess 21 formed in its upper surface between the bails 19,19'. A portion **21*a* of the recess 21 adjacent to one of the bails 19,19' is adapted for receiving a leaf spring 22 as shown in FIG. 4. Another portion 21*b* of the recess 21 lying parallel to the aforesaid portion and adjacent to the other of the bails 19,19' is adapted for receiving the locking member 13**.

Figure 1:
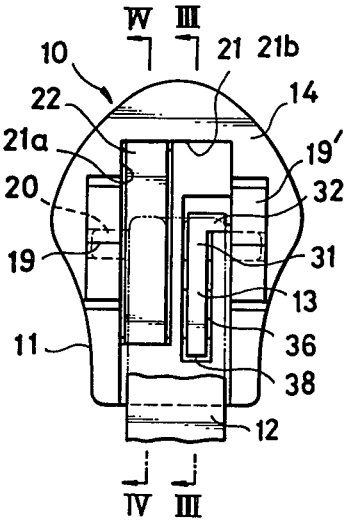
FIG. 1 is a plan view, partly cut away, of an automatic look slider constructed in accordance with the invention.
Figure 3:
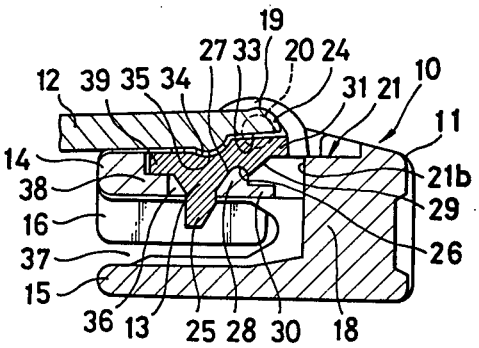
FIG. 3 is a longitudinal cross-sectional view taken on the line III—III of FIG. 1.
Figure 2:
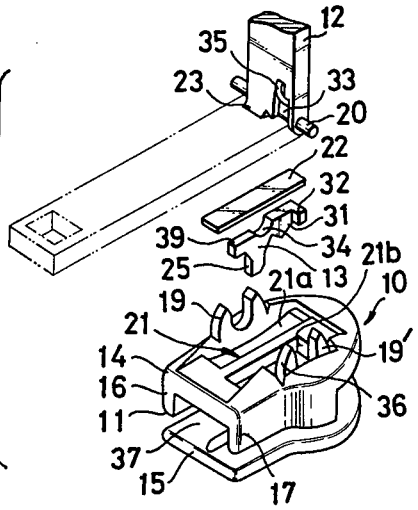
FIG. 2 is an exploded, perspective view of the slider of FIG. 1.

The pull member or tab 12 is provided at one end in FIG. 2, with a first cam portion 23 disposed in abutting relation to the leaf spring 22, and a second cam portion 24 in a similar relation to the locking member 13 for a purpose to be hereinafter explained.

Figure 7:
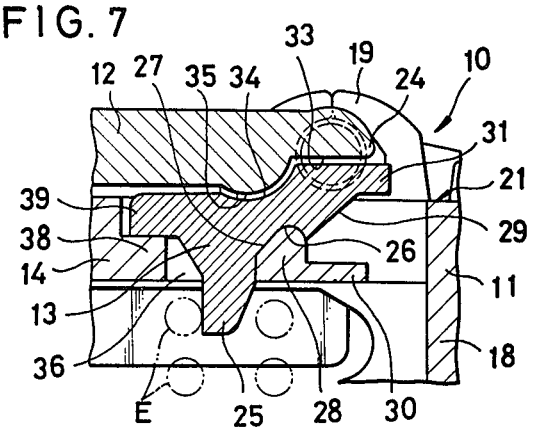
FIGS. 7 to 9, inclusive, are sectional views utilized to explain the function of the slider according to the invention.
Figure 9:
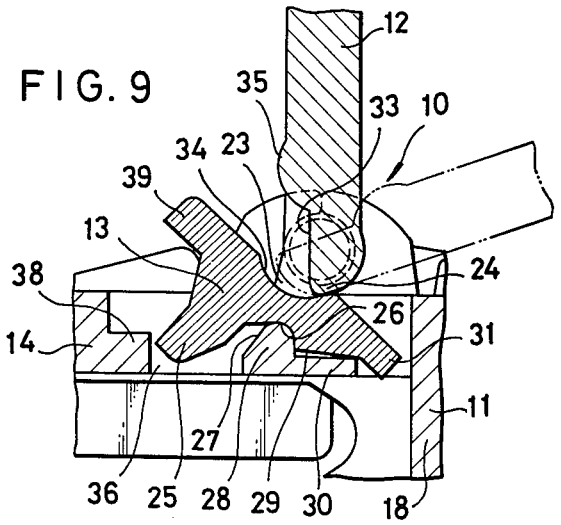

The locking member 13 has a downwardly extending locking prong 25 adapted to project into the path of the fastener elements E thereby to arrest movement of the slider 10 when the pull member 12 is in its lowered or released position as shown in FIG. 7, and to be retracted from the path of the elements E thereby to allow the slider 10 to move in either direction when the pull member 12 is in its raised position as shown in FIG. 9, the operation of the locking member 13 responsive to the action of the pull member 12 being described hereinafter in greater detail.

Figure 8:
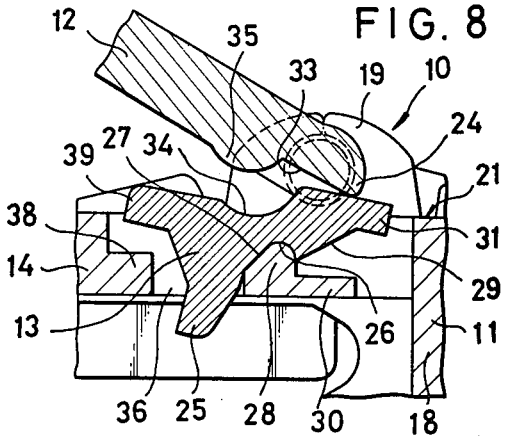

A first arcuate portion 26 is formed in the locking member 13 contiguous to the locking prong 25 for engagement with a complimentary peripheral contour 27 of a stud 28 extending upwardly from the recessed portion **21*b* of the upper wing 14. The stud 28 serves as a pivot about which the locking member 13 rotates as shown in FIGS. 7 to 9. Extending obliquely upwards from the first arcuate portion 26 is a sloped portion 29 adapted to come into abutting engagement with a stop 30 formed integral with the stud 28 thereby to limit the pivotal movement of the locking member 13 when the pull member 12 is held in its raised position releasing the locking action as shown in FIG. 9. The forward end 31 of the locking member 13 is laterally bent to form a hook 32 which engages in a cavity 33 formed in the pull member 12 adjacent to the second cam portion 24 thereby preventing disengagement of the locking member 13 from the pull member 12 during manipulation of the slider 10.**

A second arcuate portion 34 is formed in the locking member 13 in opposite relation to the first arcuate portion 26 for engagement with a complimentary surface or hump 35 projecting downwardly from the pull member 12, the hump 35 serving to quicken the locking action and at the same time, cooperating with the stud 28 to provide for secure locking position of the locking member 13 against the influence of external stress applied to the slider 10.

There is formed a through opening 36 in the recessed portion **21*b* of the upper wing 14, which opening communicates with a guide channel 37 defined between the upper and lower wings 14,15, and through which opening the locking prong 25** projects into the path of the fastener elements E.

The recessed portion **21*b* and the opening 36 define therebetween a ledge 38 against which the rearward end 39 of the locking member 13 bears when the pull member 12 is lowered to lie flat against the upper surface of the upper wing 14 to lock the slider 10, as shown in FIG. 7, the arrangement being that when lateral pull is applied to the fastener stringers, resultant stress in the locking prong 25 can be transmitted or disposed to the rearward end 39 of the locking member 13 so as to prevent deformation of or damage to the locking member 13.**

The locking action of the slider 10 is effected by rotating the pull member 12 to the position of FIG. 7 in which it is held flat against the slider body and so retained under the influence of tension of the leaf spring 22, with the locking member 13 being actuated by the pull member 12 to thrust its locking prong 25 into the space between adjacent fastener elements E.

To unlock or release the slider 10, the pull member 12 is raised against the tension of the spring 22, with its cam 24 urging the locking member 13 to pivot about the stud 28 in a direction in which the locking prong 25 disengages from the space between the fastener elements E, an intermediate stage of this unlocking operation being illustrated in FIG. 8. As the pull member 12 is thus manipulated in the unlocking direction and when it is finally lifted substantially perpendicularly to the plane of the slider 10, the sloped portion 29 of the locking member 13 is brought into abutting engagement with the stop 30, in which position the locking prong 25 is completely retracted from the path of the fastener elements E. Further rotation of the pull member 12 to the imaginary line position of FIG. 9 beyond the forward end of the slider 10 does not affect the unlocked posture of the locking member 13 due to abutting relation between the member 13 and the stop 30.

An important feature of the invention resides in the arrangement wherein the forward end portion of the locking member 13 is pivotable a relatively large angular distance so that the locking prong 25 adjacent the rearward end of the locking member 13 can be located in close proximity to the neck portion 18 when the pull member 12 is held in its locking position as shown in FIG. 7, with the results that the locking prong 25 enters smoothly between the adjacent fastener elements E which have been partly or half coupled; in other words, the prong 25 projects into an inter-element space larger than that which otherwise exists between fully coupled elements E.

Another feature of the invention is found in that the forward end of the locking member 13, though projecting upwardly in the locking position of the slider 10, is accommodated within the cavity 33 of the pull member 12 so that the over-all thickness of the slider 10 is held to a minimum, providing for a relatively low profile slider.

Figure 6:
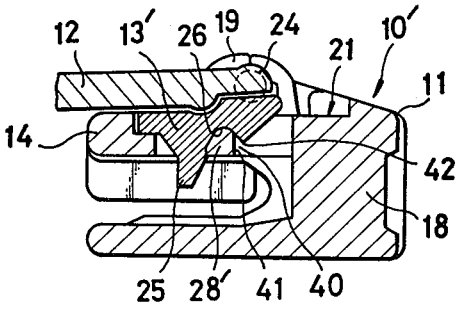
FIG. 6 is a view similar to FIG. 3 but showing modified slider construction.

FIG. 6 shows a modified form of slider 10' which is similar in most structural details to the previously advanced embodiment, except for the provision of a support stud 28' which is devoid of the stop 30 and is reduced in width as viewed in the drawing to an extent which leaves a clearance or space 40 between its front end wall 41 and the first arcuate portion 26 of the locking member 13 when the pull member 12 is in its locking position. The clearance 40 determines the radius of pivotal movement of the locking member 13 such that the terminal end 42 of the arcuate portion 26 abuts against the end wall 41 of the stud 28' thereby limiting the pivotal movement of the locking member 13 during the unlocking action of the pull member 12.

Although various minor modifications may be suggested by those versed in the art, it should be understood that I wish to embody within the scope of the patent warranted hereon, all such embodiments as reasonably and properly come within the scope of my contribution to the art.

What is claimed is:

1. An automatic lock slider for slide fasteners which comprises:

a. a slider body having an upper and a lower wing connected by a neck portion, said upper wing having a recess for receiving a leaf spring and through opening parallel with said leaf spring;

b. a pull member pivotally supported on said slider body and having at one of its ends a first cam held in abutting relation to said leaf spring and a second cam parallel to said first cam;

c. a locking member actuated by said second cam and having a locking prong movable through said through opening into the path of fastener elements and disposed in close proximity to said neck portion when the slider is in locked position; and d. a support stud extending upwardly from said recess adjacent to said through opening and having a stop adapted to limit pivotal movement of said locking member, said stud serving as a pivot about which said locking member is rotatable.

2. An automatic lock slider as claimed in claim 1 wherein said locking member has a first arcuate portion disposed in abutting relation to said stud.

3. An automatic lock slider as claimed in claim 1 wherein said locking member has a second arcuate portion engageable with a complimentary surface formed on said pull member adjacent to said second cam.

4. An automatic lock slider as claimed in claim 1 wherein said pull member is provided with a cavity adjacent to said second cam for receiving a forward end of said locking member.

5. An automatic lock slider as claimed in claim 1 wherein said stud is devoid of said stop but has an end wall defining with said first arcuate portion a clearance when the slider is in locked position.

6. An automatic lock slider as claimed in claim 1 wherein said recess and through opening define therebetween a ledge for receiving a rearward end of said locking member.

* * * * *